US009516916B2

(12) United States Patent
Derrier

(10) Patent No.: US 9,516,916 B2
(45) Date of Patent: Dec. 13, 2016

(54) FOOTWEAR WITH IMPROVED SOLE

(71) Applicant: SALOMON S.A.S., Metz-Tessy (FR)

(72) Inventor: Aude Derrier, Viviers du Lac (FR)

(73) Assignee: SALOMON S.A.S., Metz-Tessy (FR)

( * ) Notice: Subject to any disclaimer, the term of this patent is extended or adjusted under 35 U.S.C. 154(b) by 645 days.

(21) Appl. No.: 13/952,120

(22) Filed: Jul. 26, 2013

(65) Prior Publication Data

US 2014/0026443 A1 Jan. 30, 2014

(30) Foreign Application Priority Data

Jul. 27, 2012 (FR) ..... 12 02135

(51) Int. Cl.
*A43B 13/14* (2006.01)
*A43B 13/02* (2006.01)
*A43B 13/12* (2006.01)

(52) U.S. Cl.
CPC ..... *A43B 13/14* (2013.01); *A43B 13/026* (2013.01); *A43B 13/125* (2013.01); *A43B 13/141* (2013.01)

(58) Field of Classification Search
CPC ..... A43B 13/026; A43B 13/10; A43B 13/12; A43B 13/42; A43B 13/141; A43B 23/22
USPC ..... 36/102, 107, 108, 76 R, 30 R, 175, 177, 36/182
See application file for complete search history.

(56) References Cited

U.S. PATENT DOCUMENTS 1,981,677 A * 11/1934 Stark ..... A43B 23/22 36/76 R
4,506,460 A * 3/1985 Rudy ..... A43B 7/1495 36/28
5,720,118 A * 2/1998 Mayer ..... A43B 5/00 36/107
6,000,148 A 12/1999 Cretinon
7,421,805 B2 * 9/2008 Geer ..... A43B 3/0036 36/102
2004/0111920 A1 6/2004 Cretinon
2004/0250446 A1 12/2004 Greene et al.
2008/0289220 A1 11/2008 Rivas et al.
2009/0320330 A1 12/2009 Borel et al.
2010/0154257 A1 6/2010 Bosomworth et al.
2012/0079747 A1 * 4/2012 Seo ..... A43B 13/183 36/25 R

FOREIGN PATENT DOCUMENTS

FR 2 457 081 A1 12/1980
FR 2 775 875 A1 9/1999

* cited by examiner

*Primary Examiner* — Ted Kavanaugh
(74) *Attorney, Agent, or Firm* — Greenblum & Bernstein, P.L.C.

(57) ABSTRACT

An article of footwear including an outer sole assembly and an upper, the outer sole assembly extending lengthwise from a rear end to a front end, widthwise between a lateral side and a medial side, and heightwise between a surface for contact with the ground and a surface for connecting to the upper, the sole assembly including a first reinforcing layer extending lengthwise from a rear end to a front end, widthwise between a lateral side and a medial side, and heightwise between a distal surface and a proximal surface, the first reinforcing layer having transverse slits. The sole assembly includes a wear layer and a first damping layer, the wear layer demarcating the contact surface. The first damping layer is located between the wear layer and the first reinforcing layer.

17 Claims, 5 Drawing Sheets

FOOTWEAR WITH IMPROVED SOLE

CROSS-REFERENCE TO RELATED APPLICATION

This application is based upon French Patent Application No. 12/02135, filed Jul. 27, 2012, the disclosure of which is hereby incorporated by reference thereto in its entirety, and the priority of which is claimed under 35 U.S.C. §119.

BACKGROUND

1. Field of the Invention

The present invention relates to an article of footwear, such as a shoe or boot, and more particularly a shoe or boot intended for the practice of sporting activities.

This article of footwear can be used in fields such as walking, including power walking, or running on flat or mountainous terrain, mountaineering, snowboarding, ball-playing sports, or the like.

2. Background Information

A shoe may include a low upper or a high upper or a mid-upper. The shoe may also be relatively flexible or otherwise more rigid. However, irrespective of its general appearance or the activity being practiced, a shoe must meet the expectations of a user, who should be able to perform all movements required by the activity, transmit impulse forces, receive supporting forces, or perceive sensory information coming from the ground or various elements.

In particular, when walking or running on flat or mountainous terrain, it is important for the shoe to enable good foot rolling movement longitudinally, on the one hand, and transverse supports, on the other hand. This means in particular that the sole assembly of the shoe must be capable of bending longitudinally, along a transverse axis, while having sufficient transverse bending strength, at least in certain zones. To meet these needs, the prior art has proposed solutions.

For example, according to the document FR 2457081, a shoe includes a sole assembly structured to allow longitudinal bending while preventing or strongly opposing transverse bending. In practice, the sole assembly disclosed in this document includes a reinforcing layer embedded in a matrix. The reinforcement layer includes transverse slits which, by definition, extend through the thickness of the layer and also open out in the area of a lateral edge or in the area of a medial edge of the layer. Two successive slits open out in the area of a different edge of the layer. The shoe according to the document FR 2457081 is satisfactory insofar as the user can perform the movements necessary to the activity; in particular, the user can freely move the foot and take strong transverse supports. The transverse supports are stable because, between two slits, the reinforcement provides transverse stiffness to the sole assembly. However, this shoe has certain drawbacks.

Indeed, the shoe appears to have a reduced grip on the ground. This means, for example, that the shoe may slip when subject to a bias that would otherwise be insufficient to cause a shoe, of the same size and without a reinforcing layer, to slip. This phenomenon of slippage or undesired sliding can occur when taking supports on the ground, especially on a slope, and in the presence of impulses related to acceleration, braking, or the like. The phenomenon of slippage or undesired sliding also occurs in the transverse direction. As a result, walking or running is less accurate and less reliable, which is a paradox causing fatigue for the user.

SUMMARY

In view of the foregoing, the present invention generally improves upon footwear of the prior art. In particular, the invention ensures that an article of footwear, such as a shoe or boot, the sole assembly of which includes a reinforcing layer having transverse slits, has a better grip on the ground. In other words, it is desired to ensure that the grip of the shoe on the ground is improved when taking supports dynamically, e.g., during acceleration, braking, and in the presence of other impulses. It is also desired to improve the grip and to make the supports more stable and more accurate, especially when the contact between the sole assembly and the ground is localized. This type of contact occurs especially on rough terrain, or when moving on an inclined terrain in a direction transverse relative to the slope. Sometimes, only a lateral portion or medial portion of the sole assembly comes into contact with the ground. Under these conditions, the risk of undesired slippage is greater. In more concise terms, the aforementioned desired object is to increase the grip on the ground, irrespective of the operating mode of the footwear article. In the following description, the term "shoe" is used, although without intending to limit the scope of the invention is applicable various forms of footwear that could be characterized by other terminology.

As described below, the invention provides the aforementioned grip in a broad manner, that is to say, on wet, moist, or dirty terrain, as well as on more predictable terrain, such as dry land.

The invention also provides some damping capability in the area of the outer sole assembly. The invention seeks to optimize the behavior of the sole assembly throughout the entire, or at least a significant portion of, the period of time it is in contact with the ground, depending upon the activity being performed and/or the type of terrain involved.

Further, the invention improves accuracy in the transmission of sensory information or impulses related to walking or running.

Still further, the invention reduces the mass of the outer sole assembly as much as possible.

Broadly speaking, the invention reconciles a plurality of abilities in a single shoe, including free and even rolling movement of the sole assembly on the ground, sufficient grip on even ground, and sufficient adherence or grip on uneven ground. This means a versatile, more efficient shoe in all situations and on all terrains.

Finally, the invention also improves the cooperation between a shoe and an accessory such as a crampon.

To this end, the invention proposes a shoe including an outer sole assembly and an upper, the outer sole assembly extending lengthwise from a rear end to a front end, widthwise between a lateral side and a medial side, and heightwise between a ground-contacting surface and a surface for connecting to the upper, the sole assembly including a first reinforcing layer extending lengthwise from a rear end to a front end, widthwise between a lateral side and a medial side, and heightwise between a distal surface and a proximal surface, the first reinforcing layer having transverse slits.

The sole assembly of a shoe according to the invention includes a wear layer and a first damping layer, the wear layer demarcating the contact surface, and the first damping layer being located between the wear layer and the first reinforcing layer.

The damping layer dampens the impacts, the impulses related to running or walking, or the sensory information passing between the wear layer and the reinforcing layer. In other words, the damping layer serves as a mechanical filter. As such, this layer enables small elastic displacements, occurring reversibly, of subdivisions or the entirety of the wear layer in relation to the reinforcing layer.

Because it elastically deforms reversibly, particularly in compression and/or shearing, the damping layer absorbs excess energy associated with supports, impacts, impulses, changes of terrain or relief, or with the transmission of sensory information. As a result, it is necessary to apply more energy to the outer sole assembly, compared to a shoe having no damping layer, in order to obtain a slip or an undesired sliding.

One of the resulting advantages is that a shoe according to the invention has a better grip on the ground than a shoe, the sole assembly of which having no damping layer under the reinforcing layer.

The improved adherence to the ground, for the shoe of the invention, is obtained on various terrains, including wet, damp, dry, flat or sloped, smooth, or uneven terrains, especially due to the more progressive reversible elastic deformation of the sole assembly.

Thus, the damping layer improves the behavior of the sole assembly for a significant portion, if not the entirety, of the time it is in contact with the ground.

The invention also improves accuracy in the transmission of sensory information or impulses, because slippage is reduced or nonexistent.

The invention minimizes user fatigue, by reducing the mass of the outer sole assembly, as the damping layer is lightweight, and by improving shock absorption.

As will be understood more clearly from the following description, at least for one embodiment, a shoe of the invention reconciles a plurality of abilities, including free and even rolling movement of the sole assembly on ground, frank and accurate transverse support, sufficient adherence on even terrain, and sufficient adherence or grip on uneven terrain. The shoe is therefore versatile and efficient in all situations.

Also, the shoe improves the perception of sensory information and the transmission of impulses to the ground when it is provided with a crampon.

BRIEF DESCRIPTION OF DRAWINGS

Other characteristics and advantages of the invention will be better understood from the description which follows, with reference to the annexed drawings illustrating, by way of non-limiting embodiments, how the invention can be carried out, and in which:

FIG. 2 is similar to FIG. 1, with an exploded view of the outer sole assembly;

DETAILED DESCRIPTION

The first embodiment described below relates more specifically to a shoe for walking or running on flat or uneven terrain. However, the invention is applicable to other fields of endeavor such as those mentioned above.

The first embodiment is described below with reference to FIGS. 1-7.

Figure 1:
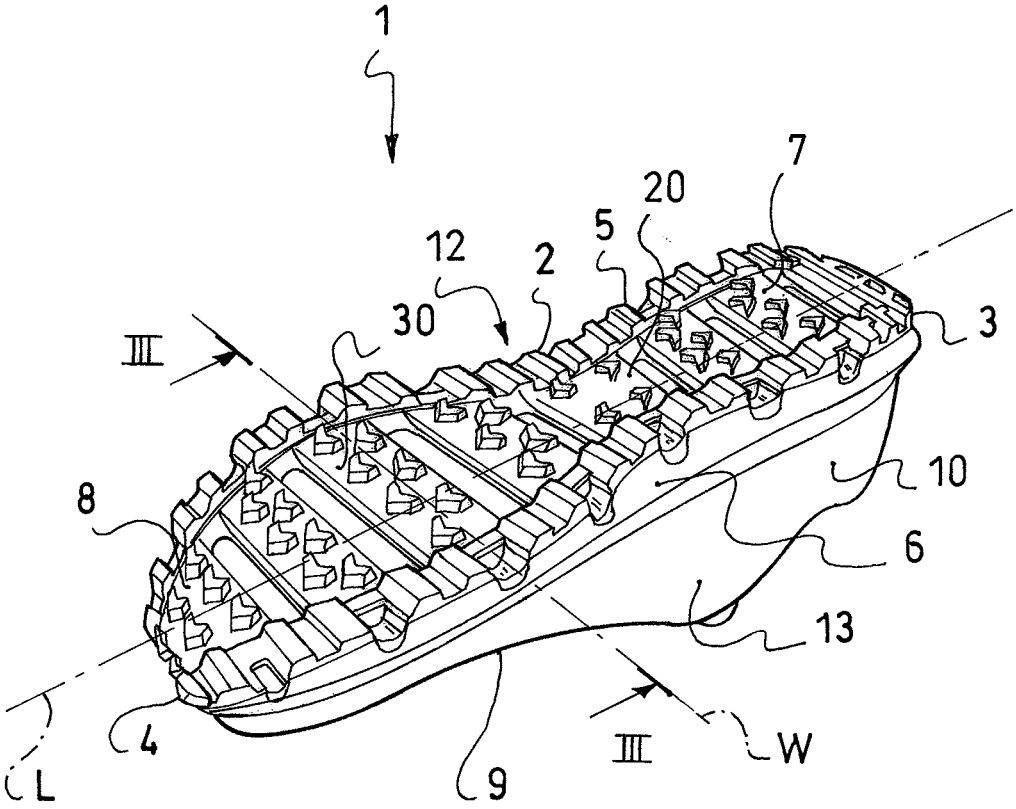
FIG. 1 is a perspective front view, from beneath a shoe, according to a first embodiment of the invention.

As shown in FIGS. 1 and 2, a walking shoe is adapted to receive the foot of a user.

As known and generally speaking, the shoe 1 includes an outer sole assembly 2 extending along a longitudinal direction L, between a rear end 3 and a front end 4, and along a transverse direction W, between a lateral side 5 and a medial side 6. The sole assembly 2 includes a rear portion, or heel 7, and a front portion 8. According to the first embodiment, the sole assembly 2 is a unitary element, in the sense that the heel 7 and the front portion 8 are co-extensive. However, these portions 7, 8 could be separated and spaced apart.

In addition, the shoe 1 includes an upper 9 arranged on the sole assembly. As shown, the upper 9 includes a lower portion 10, provided to surround the foot, but does not have an upper portion that extends over and/or above the ankle. However, the upper could be provided to also include such an upper portion.

The upper 9 may include a lateral quarter 12, a medial quarter 13, and a tongue. The tongue, not visible in the drawing figures, connects quarters 12, 13 to one another in order to provide the upper 9 with continuity. However, the tongue could be omitted. In this case, the quarters 12, 13 can remain separate or can overlap.

A tightening device, not described in detail here, is generally provided for reversibly tightening the upper 9. However, the tightening device could be omitted from the shoe 1.

Irrespective of the structure of the upper, the outer sole assembly 2 extends heightwise between a ground-contacting surface 20 and an upper-connecting surface 21. The surface 20, by definition, is adapted to contact the ground or various supports. The surface 21 connects the outer sole assembly 2 to the upper 9 via any of various connection expedients, which may or may not be permanent, such as gluing, nesting, or any equivalent expedients.

The outer sole assembly 2 includes a first reinforcing layer 22 extending lengthwise along the longitudinal direction L, from a rear end 23 to a front end 24, widthwise along the transverse direction W, between a lateral side 25 and a medial side 26, and heightwise between a distal surface 27 and a proximal surface 28. The distal surface 27 is the one of the two surfaces 27, 28 that is farther from the upper 9, whereas the proximal surface 28 is the nearer thereto. The first reinforcing layer 22 has transverse slits 29, which are described in more detail below.

According to the invention, the outer sole assembly 2 includes a wear layer 30 and a first damping layer 31, the wear layer 30 demarcating the surface 20 for contact with the ground, and the first damping layer 31 is located between the wear layer 30 and the first reinforcing layer 22. The damping layer 31 absorbs the impacts, the impulses, or other forces passing through the outer sole assembly 2, especially between the wear layer 30 and the reinforcing layer 22. Indeed, the entirety or subdivisions of the damping layer 31 deform elastically and reversibly to enable a relative displacement of the wear layer 30, or of subdivisions of this layer in relation to the reinforcing layer 22. The deformations of the damping layer dissipate the energy which, by corollary, increases the force intensity necessary to cause the shoe to slip. These deformations also enable a better adaptation of the wear layer to various ground types and contours. In other words, the grip on the ground is better with the shoe of the invention.

Still according to the first embodiment, as can be understood with reference to FIGS. 1-4, the damping layer 31 has a reduced thickness, between 1.0 and 10 mm or, according to a narrower range that yield good results, values of 1.0 to 5.0 mm. This provides this layer with a minimum mass. As a result, the shoe 1 remains light and user fatigue is reduced.

Along the transverse direction W, the width of the first reinforcing layer 22 is between 25 and 100% of the width of the outer sole assembly 2 or, according to a narrower range that yield good results, values between 75 and 100%. The reinforcing layer 22 serves to provide transverse stiffness, a function all the more significant that its width is substantial. The user can therefore take more stable supports or perceive sensory information better, even if contact with the ground occurs only in the area of the lateral side 5 or only in the area of the medial side 6 of the sole assembly 2. The user also perceives sensory information better, and transmits impulses to the ground more accurately, in a case in which the shoe is provided with a crampon.

Along the longitudinal direction L, the length of the first reinforcing layer 22 is between 25 and 100% of the length of the outer sole assembly 2. This means that the first reinforcing layer 22 may longitudinally occupy a smaller or, conversely, a greater portion of the sole assembly 2. It has been observed that substantial lengths, between 75 and 100% of the length of the outer sole assembly 2, yield good results. This is because the transverse supports are improved over a significant length of the sole assembly 2. Here again, the cooperation with a crampon is improved.

For example, the slits 29 are provided to open out alternately in the area of the lateral side 25 and in the area of the medial side 26 of the first reinforcing layer 22. This provides each of the sides 25, 26 with the same ability to bend longitudinally, along a transverse axis of the reinforcing layer 22. For an alternative construction, it is possible for the slits 29 to open out in area of only one of the lateral 25 and medial 26 sides of the first reinforcing layer 22. According to this example, shown in FIG. 2A, the one of the sides in the area of which the slits open out has a discontinuous structure, whereas, conversely, the one of the sides in the area of which none of the slits open out has a continuous structure. The side having the continuous structure is more rigid, or less flexible, in longitudinal bending, relative to the side having the discontinuous structure. In other words, the sides 25, 26 flex differently in bending. Thus, it is possible, depending upon the arrangement of the slits, to provide the sole assembly 2 with specific mechanical properties at certain locations.

Generally speaking, a slit 29 has a length between 50 and 100% of the width of the first reinforcing layer 22, in the area of a given transverse cross section of the outer sole assembly 2. Stated another way, as shown in the drawings, for slits having a length less than 100% of the width of the first reinforcing layer, an open end of the slit 29 opens at a first side of the first reinforcing layer 22 and a closed end of the slit is spaced from a second side of the reinforcing layer, and the closed end of the slit is closer to the second side of the reinforcing layer than to the first end of the slit. Also consistent with what is shown in the drawings, the closed end of a slit 29 is closer to the second side of the reinforcing layer than to a longitudinal vertical median plane of the reinforcing layer 22. The longer the slit 29, the greater the ability in longitudinal bending. The extreme case is that of a length of 100%. This means that the longitudinal structure of the reinforcing layer 22 is then discontinuous. The spacing between two transverse portions of the layer 22 remains stable because these portions are affixed, for example by gluing, to the remainder of the sole assembly.

In practice, a slit 29 has a width between 0.1 and 30 mm. The narrower the slits, the greater the transverse bending strength. In other words, the narrower the slits, the more stable the shoe in transverse supports.

According to the first embodiment of the invention, and without limitation, slits 29 are provided along the entire length of the first reinforcing layer 22. In this case, this entire layer is capable of bending longitudinally. The rolling movement of the foot is all the better, especially in cases in which the reinforcing layer 22 extends longitudinally over a substantial portion of the sole assembly.

Figure 2A:
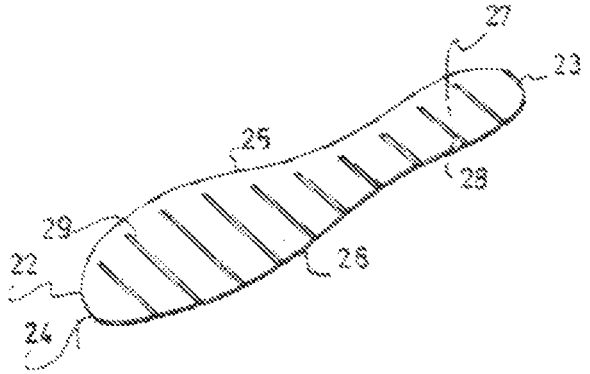
FIGS. 2A, 2B, 2C, and 2D illustrate various alternative embodiments of the reinforcing layer.
Figure 2B:
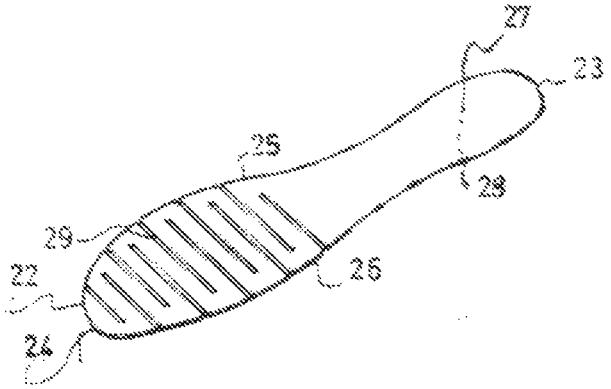

Differently, according to alternative embodiments shown in FIG. 2B, slits 29 are provided only between the front end 24 of the first reinforcing layer 22 and a point spaced rearward by a value of 50% of the length of this layer 22, from the front end 24. This is to promote the longitudinal bending of the front of the layer. If the layer extends along a substantial length, or even the entire length, of the outer sole assembly 2, then it is the front of the outer sole assembly 2 that can bend longitudinally. Consequently, the foot rolling movement is easy, because the toes have more freedom. Moreover, the transverse supports in the area of the toes remain very strong and accurate, due to the transverse bending strength of the reinforcing layer 22.

Figure 2C:
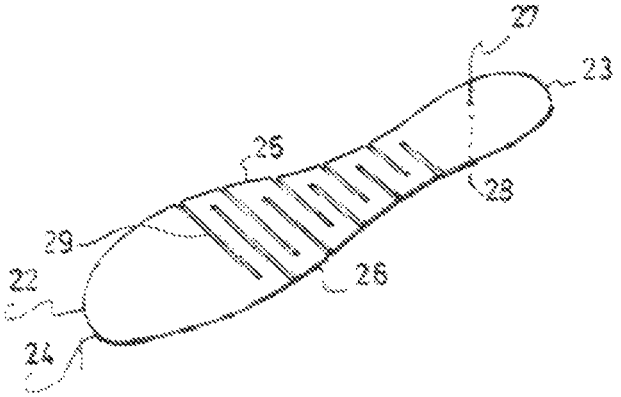
Figure 2D:
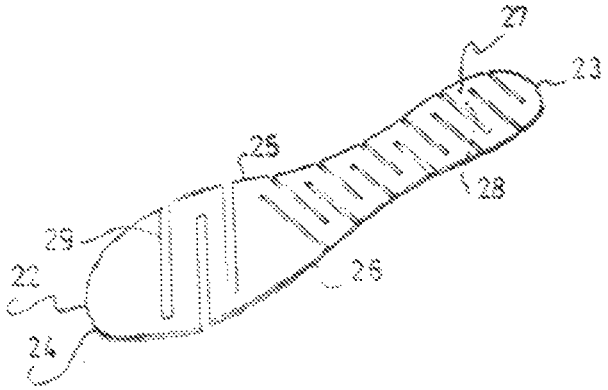

Still differently, according to other alternative embodiments [[not shown in FIG. 2C, slits 29 are provided only between a point moved rearward by a value of 25% of the length of the first reinforcing layer 22, from the front end 24, and a point spaced forward by a value of 25% of the length of the first reinforcing layer 22, from the rear end 23. This means that it is essentially the central portion of the reinforcing layer 22 which is adapted to bend longitudinally. If this layer 22 extends along a substantial length, or even the entire length, of the outer sole assembly 2, it is then observed that the sole assembly 2 can be deformed in longitudinal torsion, that is to say along a longitudinal axis. This makes it easier to take supports on transverse slopes.

With reference to the first embodiment of the invention being described, and to the possible alternatives and variations, the slits 29 are parallel to one another. This enables the first reinforcing layer 22, and therefore also the sole assembly 2, to evenly bend longitudinally. The rolling movement of the foot tends to be flat, which is suitable for use on flat terrain. Alternatively, it is possible that at least two slits 29 form with one another an angle whose value is between 0 and 30°, an example being shown in FIG. 2D. In this case, the rolling movement of the foot can occur with a slight longitudinal torsion, which promotes use on rough terrain.

Figure 5:
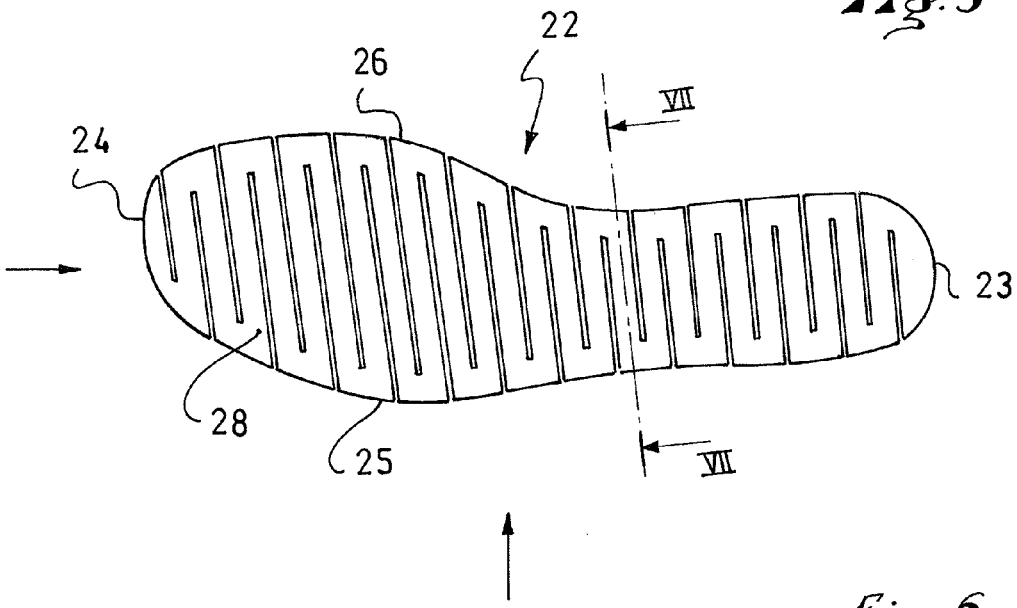
FIG. 5 is a plan view of a reinforcing layer of the outer sole assembly of the shoe of FIG. 1.
Figure 6:
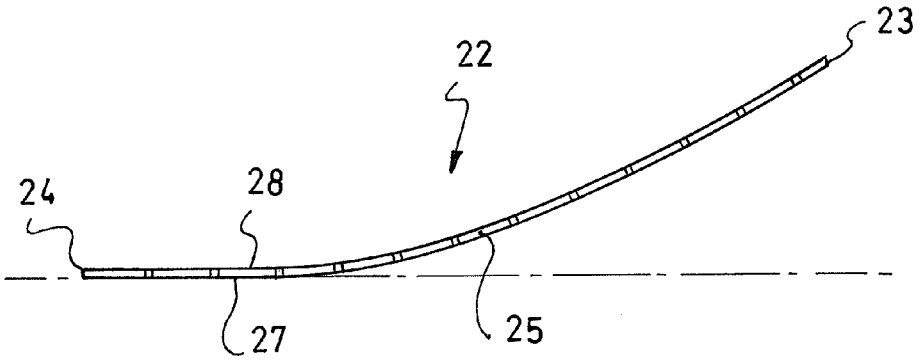
FIG. 6 is a side view of the reinforcement of FIG. 5, in a configuration in which the outer sole assembly bends longitudinally.
Figure 7:
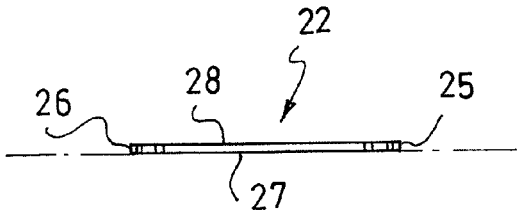
FIG. 7 is a cross section along the line VII-VII of FIG. 5.

In any event, the first reinforcing layer 22 is capable of bending longitudinally, while remaining transversely flat, as can be understood with reference to FIGS. 5-7. Consequently, the outer sole assembly 2 is adapted to bend longitudinally, which is suitable for a good foot rolling movement, and to retain its natural shape transversely, thereby making the transverse supports on the ground more precise.

In a non-limiting fashion, the first reinforcing layer 22 here is made of a fiber-reinforced synthetic material. The fibers can be synthetic or natural, such as carbon, glass, flax, or the like. The first reinforcing layer 22 is lightweight, due to this makeup, which is beneficial to the entire shoe. Nevertheless, other materials, such as plastic, metal, a metal alloy, or any equivalent, may be used to make the reinforcing layer 22.

Figure 3:
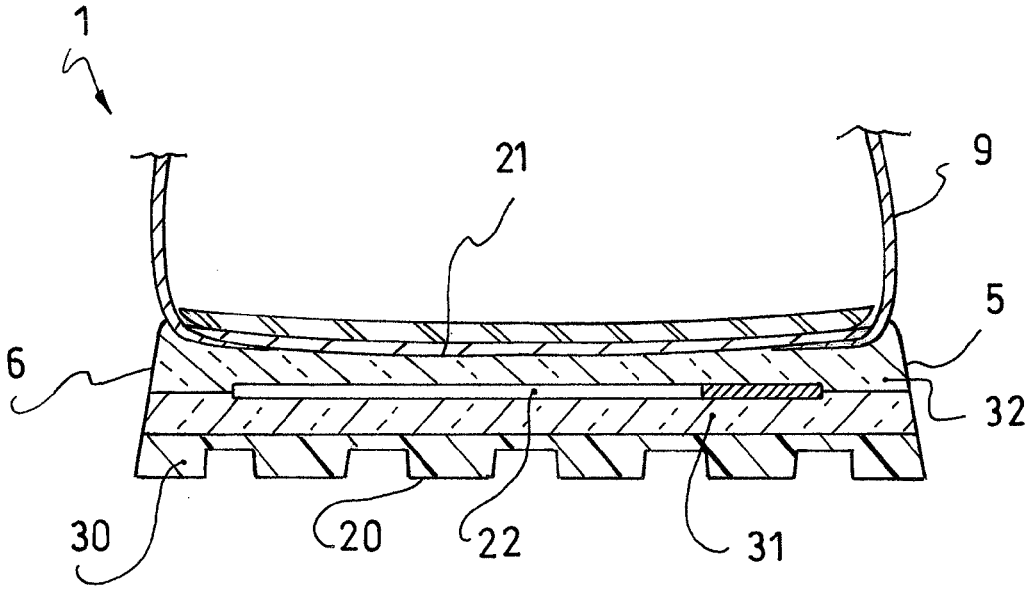
FIG. 3 is a cross section along the line III-III of FIG. 1.
Figure 4:
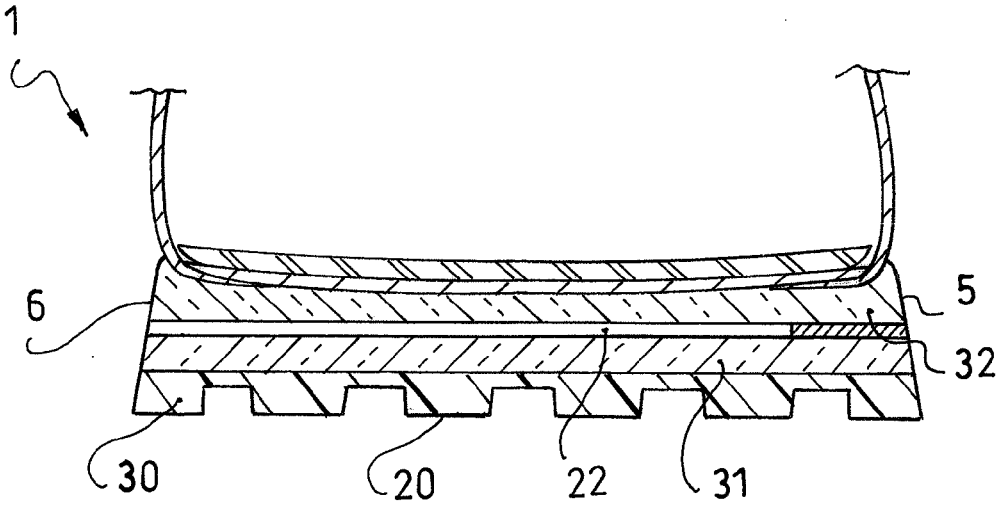
FIG. 4 is similar to FIG. 3, for an alternative embodiment that is part of the first embodiment.

With reference more specifically to FIGS. 2-4, the outer sole assembly 2 includes a second damping layer 32, and the first reinforcing layer 22 is located, heightwise, between the first damping layer 31 and the second damping layer 32. The first 31 and second 32 damping layers are affixed to one another by a means such as gluing, or any equivalent, to confine the first reinforcing layer 22. Alternatively, the first 31 and second 32 damping layers may be provided to form a unitary piece, i.e., a one-piece construction. In other words, the first reinforcing layer 22 is embedded in an assembly which, in the end, is a damping layer located between the wear layer 30 and the upper 9.

Figure 8:
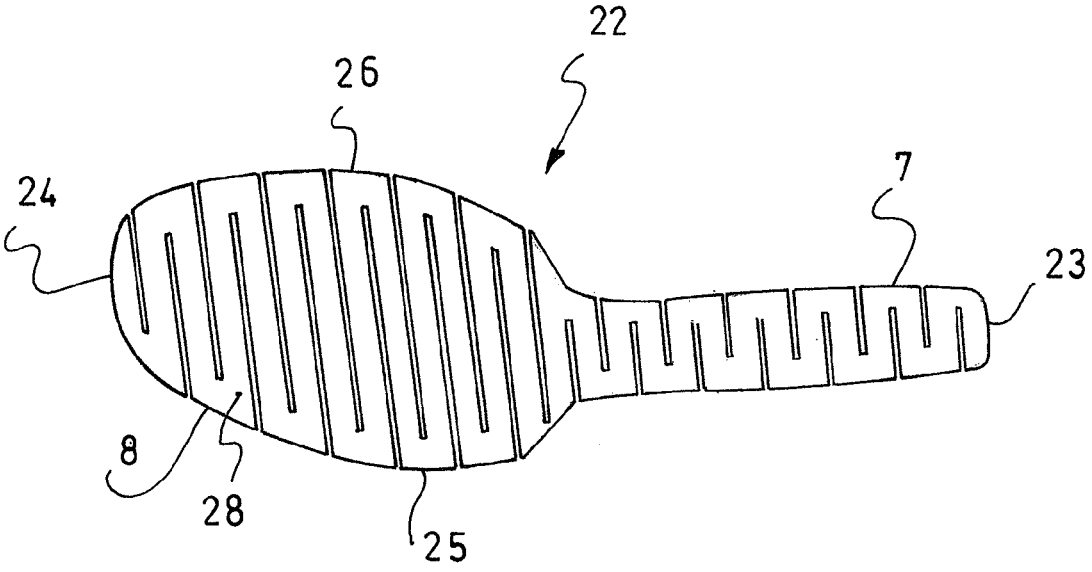
FIG. 8 is a view similar to FIG. 5, according to a second embodiment of the invention.

The second embodiment of the invention is illustrated below with reference to FIG. 8. For reasons of convenience, the elements shared with the first embodiment are designated by the same reference numerals. Only the differences are highlighted.

This embodiment includes a first reinforcing layer 22, with a rear end 23, a front end 24, a lateral edge 25, a medial edge 26, and transverse slits 29.

The second embodiment is specific in that, in the area of the rear portion 7 of the outer sole assembly 2, the width of the first reinforcing layer 22 is between 25 and 50% of the width of the outer sole assembly 2, and in the area of the front portion 8, the width of the first reinforcing layer 22 is between 50 and 100% of the width of the outer sole assembly 2. This assumes that the first reinforcing layer 22 extends along at least 60% of the length of the outer sole assembly 2. In the end, the first reinforcing layer 22 is rather narrow at the rear and wider at the front. This makes the outer sole assembly 2 more rigid transversely at the front than at the rear.

The invention is not limited to the embodiments described above, and includes all technical equivalents that fall within the scope of the claims that follow.

In particular, one can provide to use a plurality of reinforcing layers. For example, one reinforcing layer may be located toward the front of the shoe, and the other toward the rear.

The wear layer 30 may be discontinuous, that is to say, formed of separate elements respectively affixed to the first damping layer 31.

Each damping layer 31, 32 is formed, for example, of a low density synthetic material, such as EVA (ethyl vinyl acetate), or any equivalent material.

The structure of the outer sole assembly 2 may be minimalist, that is to say, it may exclusively include the wear layer 30, the first damping layer 31, and the first reinforcing layer 22; or the wear layer 30, the first damping layer 31, the first reinforcing layer 22, and the second damping layer 32, to the exclusion of any additional layer, or to the exclusion of any additional elements.

At least because the invention is disclosed herein in a manner that enables one to make and use it, by virtue of the disclosure of particular exemplary embodiments of the invention, the invention can be practiced in the absence of any additional element or additional structure that is not specifically disclosed herein.

The invention claimed is:

1. An article of footwear comprising:

outer sole assembly;

an upper extending upwardly from the outer sole assembly;

the outer sole assembly extending lengthwise from a rear end to a front end, widthwise between a lateral side and a medial side, and heightwise between a ground-contacting surface and an upper-connecting surface;

the outer sole assembly comprising:

a first reinforcing layer extending lengthwise from a rear end to a front end, widthwise between a lateral side and a medial side, and heightwise between a distal surface and a proximal surface;

the first reinforcing layer having transverse slits;

a wear layer; and a first damping layer;

the wear layer demarcating the ground-contacting surface;

the first damping layer being located between the wear layer and the first reinforcing layer;

the first damping layer having a width at least as great as a width of the first reinforcing layer along a vertical transverse plane;

at least one of the slits having an open end at a first side of the first reinforcing layer and a closed end spaced from a second side of the reinforcing layer;

the closed end of the slit being closer to the second side of the first reinforcing layer than to a longitudinal vertical median plane of the first reinforcing layer.

2. An article of footwear according to claim 1, wherein:

along the transverse direction, the width of the first reinforcing layer is between 25 and 100% of the width of the outer sole assembly.

3. An article of footwear according to claim 1, wherein:

along the longitudinal direction, the length of the first reinforcing layer is between 25 and 100% of the length of the outer sole assembly.

4. An article of footwear according to claim 1, wherein:

the slits open out in an area of only one of the lateral and medial sides of the first reinforcing layer.

5. An article of footwear according to claim 1, wherein:

the slits open out alternately in an area of the lateral side and in an area of the medial side of the first reinforcing layer.

6. An article of footwear according to claim 1, wherein:

at least one of the slits has a length 100% of the width of the first reinforcing layer.

7. An article of footwear according to claim 1, wherein:

at least one of the slits has a width between 0.1 and 30 mm.

8. An article of footwear according to claim 1, wherein:

the slits are provided over substantially an entire length of the first reinforcing layer.

9. An article of footwear according to claim 1, wherein:

the slits are provided only between the front end of the first reinforcing layer and a point spaced rearward by a value of 50% of the length of the first reinforcing layer, from the front end.

10. An article of footwear according to claim 1, wherein:

the slits are provided only between a point moved rearward by a value 25% of the length of the first reinforcing layer, from the front end, and a point spaced forward by a value of 25% of the length of the first reinforcing layer, from the rear end.

11. An article of footwear according to claim 1, wherein:

the slits are mutually parallel.

12. An article of footwear according to claim 1, wherein: at least two of the slits form with each other an angle between 0 and 30°.

13. An article of footwear according to claim 1, wherein: in an area of the rear portion of the outer sole assembly, a width of the first reinforcing layer is between 25 and 50% of a width of the outer sole assembly;

in an area of the front portion, a width of the first reinforcing layer is between 50 and 100% of a width of the outer sole assembly.

14. An article of footwear according to claim 1, wherein: the first reinforcing layer is comprised of a fiber-reinforced synthetic material.

15. An article of footwear according to claim 1, wherein: the outer sole assembly includes a second damping layer; the first reinforcing layer is located, heightwise, between the first damping layer and the second damping layer.

16. An article of footwear according to claim 1, wherein: a transversely extending width of the first damping layer is greater than the width of the first reinforcing layer.

17. An article of footwear according to claim 1, wherein: the first damping layer has a one-piece construction from the medial side of the outer sole assembly to the lateral side of the outer sole assembly.

* * * * *